US005357553A

United States Patent [19]

Ferlic et al.

[11] Patent Number: 5,357,553

[45] Date of Patent: Oct. 18, 1994

[54] RADOIGRAPHIC GRID

[76] Inventors: Daniel J. Ferlic, 406 Birchwood Ave., White Bear Lake, Minn. 55110; Randolph M. Ferlic, 2254 S. 86th Ave., Omaha, Nebr. 68131

[21] Appl. No.: 203,001

[22] Filed: Feb. 28, 1994

[51] Int. Cl.[5] ..... G21K 1/00

[52] U.S. Cl. ..... 378/154; 378/155

[58] Field of Search ..... 378/154, 155, 19, 147, 378/7; 250/363.1

[56] References Cited

U.S. PATENT DOCUMENTS 4,706,269 11/1989 Reina et al. ..... 378/154

4,901,335 2/1990 Ferlic et al. ..... 378/37

5,291,539 3/1994 Thumann et al. ..... 378/154

*Primary Examiner*—David P. Porta

*Assistant Examiner*—Don Wong

*Attorney, Agent, or Firm*—Kinney & Lange

[57] ABSTRACT

A radiographic grid includes a grid housing having first and second side walls, a first cover sheet disposed on the grid housing, and a plurality of x-ray radiation absorbing lamellae disposed between the first and second side walls of the grid housing. Each of the plurality of lamellae has at least one alignment tab protruding from a lateral edge thereof for engaging the cover sheet such that each of the lamellae are maintained in alignment with respect to each other.

20 Claims, 3 Drawing Sheets

RADOIGRAPHIC GRID

BACKGROUND OF THE INVENTION

The present invention relates to radiographic grids for use in an x-ray apparatus, especially for use in an x-ray mammography apparatus.

It has been well known since the early days of radiography that secondary or scattered x-rays reduce the contrast of the x-ray image. The low difference in x-ray absorption characteristics between cancerous and non-cancerous tissue has made mammography particularly susceptible to imaging problems caused by scattered radiation. A conventional Bucky grid consisting of a series of lead foil strips separated by strips of x-ray transparent spacers helps remove scattered radiation from radiographic fields.

The thin strips of x-ray radiation absorbing material are called lamellae and are substantially aligned with the incident course of the radiation from the x-ray source, with the x-rays being transmitted through the gaps between the lamellae. The grid is positioned between the object and image receptor to reduce scatter radiation thereby improving image contrast on the film. The degree of alignment required of the lamellae is a function of the ratio of the height of the lamellae to the width of the gaps between the lamellae. Radiation not aligned with radiation from the source is blocked by the grid from reaching the film.

Bucky grids used in mammography are either stationary flat grids or reciprocating flat grids having an interspace material between adjacent lamellae. U.S. Pat. No. 4,901,335 to Ferlic et al. teaches a reciprocating grid having at least a 90% open area at all positions of its travel to transmission of directly incident x-ray radiation (i.e. radiation perpendicular to the tangent of the direction of travel of the grid at the point of incidence). The x-ray transmitting slots are formed between x-ray absorbing lamellae, which extend radially in directions from an axis through the x-ray source. The spacing between the lamellae of the grid is air to reduce x-ray absorption. At least a 7:1 grid ratio between lamellae height to open air gap width, compared to grid ratios between 2:1 and 5:1 for grids having interspace material between the lamellae, is used to minimize transmission of a scattered x-ray radiation through the grid, thereby enhancing image quality.

The large height to gap ratio with air spaced gaps between the lamellae is obtainable in part by use of radially aligned lamellae, which substantially eliminates grid focus problems. Thus, maximum aligned transmission is achieved at all points of the grids travel. A low density of lamellae in the grid, typically on the order of three to six lamellae per centimeter, reduces the need for exceptionally close tolerances in manufacturing of the lamellae and permits the use of lamellae of sufficient width so as to be substantially self supported between opposed side walls of the grid housing and between a top and a bottom cover sheet so that the interspace material is not necessary for supporting the lamellae.

Although the lamellae are supported independently within the grid housing it has been difficult to maintain the lengthwise straightness of the lamellae as they are assembled. In U.S. Pat. No. 4,901,335 Ferlic et al teaches that lamellae are individually positioned and aligned with respect to each other in a grid housing and then the cover sheet is substantially covered with an adhesive and pressed down onto the edges of the lamellae. This process is extremely time consuming and subject to the inherent tolerances of the technician assembling the grid. It typically on the order of several hours and even days to assemble a grid as described in the '335 patent. In addition, if the lamellae are not initially positioned straight and parallel to each other or if the lamellae become dislodged from the adhesive and warp, then there is a reduction in the transmission of the primary x-ray radiation and artifacts occur due to the misalignment.

Another method for attaching lamellae within grid housing has been to provide carbon fiber plates having a thickness of 1 mm on the top and bottom of individual tantalum lamellae. The carbon-fiber plates have grooves in them to provide the proper spacing between the lamellae and then the lamellae are glued into the individual slots one at a time using an adhesive. This method, like the method above, is extremely time consuming and results in artifacts if the lamellae become dislodged or warped.

SUMMARY OF THE INVENTION

The present invention relates to a radiographic grid including a grid housing having first and second side walls; a first cover sheet disposed on the grid housing; and a plurality of x-ray radiation absorbing lamellae disposed between the first and second side walls of the grid housing. Each of the plurality of lamellae has alignment means protruding from a lateral edge thereof for engaging the cover sheet such that each of the lamellae are maintained in alignment with respect to each other.

In an illustrated embodiment the alignment means includes at least one tab protruding upward from a first edge of the lamellae, and the cover sheet includes a plurality of slits corresponding to the tabs and engageable therewith. In addition, the alignment means further includes at least one tab protruding upward from a second edge of the lamellae opposite the first edge and the radiographic grid further includes a second cover sheet disposed on the grid housing opposite the first cover sheet. The second cover sheet includes a plurality of slits corresponding to and engageable with the tabs protruding from the second edge of the lamellae.

DETAILED DESCRIPTION OF THE PREFERRED EMBODIMENTS

Figure 1:
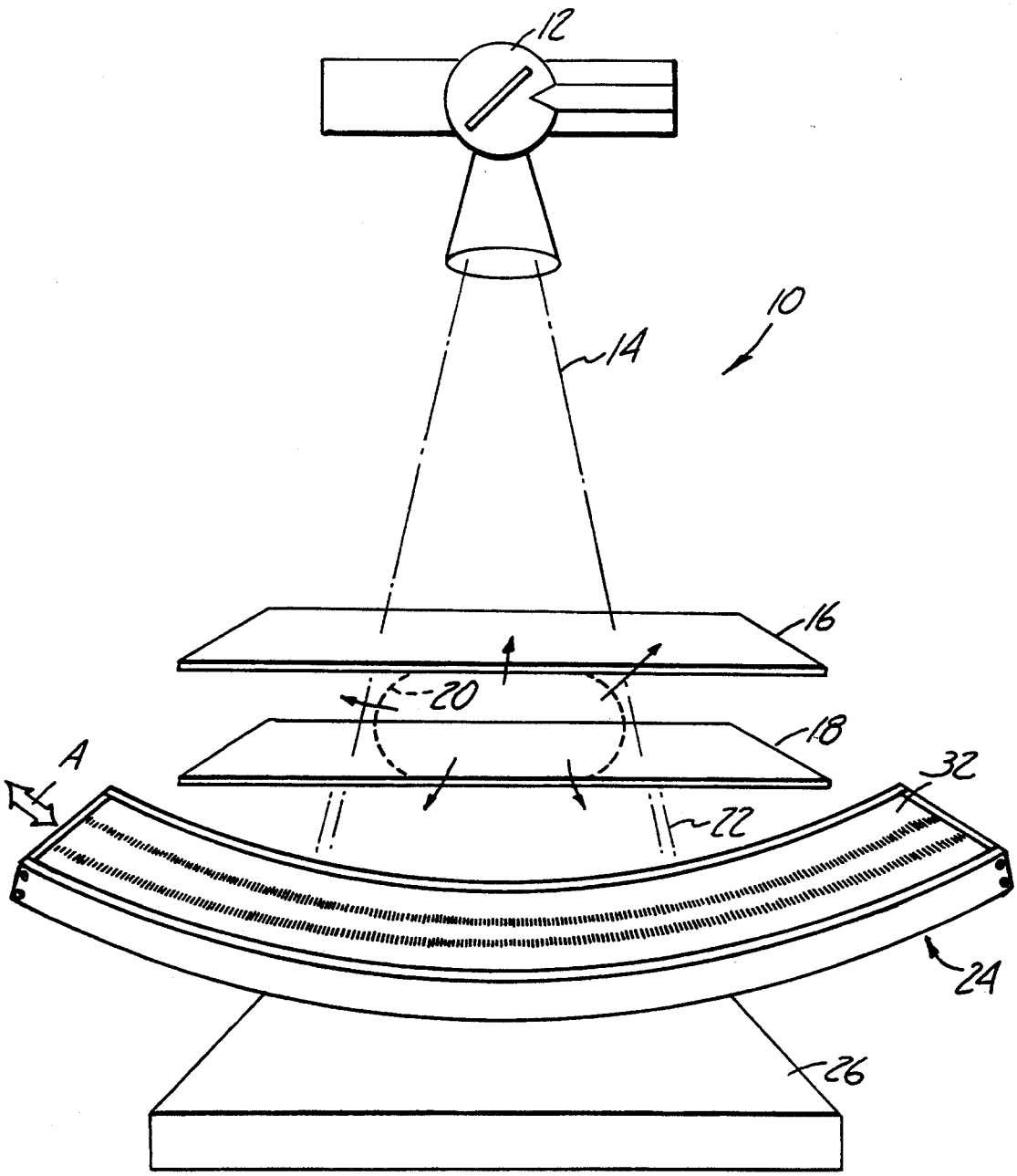
FIG. 1 is a perspective view of a mammography apparatus utilizing a radiographic grid according to the present invention.

FIG. 1 illustrates a schematic arrangement of a mammography apparatus 10. The x-ray source 12 emits a cone-shaped x-ray beam 14 towards mammography apparatus 10. A woman's breast 20, shown in hatching, is compressed between upper compression plate 16 lower compression plate 18 where it is exposed to the incident x-ray beam 14. X-ray beam 14 is shaped by an operator as required to fully illuminate the breast 20 but no more. Scattered x-rays from breast 20 are indicated by arrows 22. Compression plate 16 and 18 are formed from polyester sheets having a thickness of 0.1778 mm. The compression plates generate little secondary radiation and exhibit negligible scattering of radiation. A reciprocating slot grid 24 is disposed between compression plate 18 and a film/screen cassette 26 for preventing transmission of scattered x-ray radiation to the film/screen cassette. Slot grid 24 and film screen/cassette 26 are positioned closely to lower compression plate 18 to minimize magnification effects. U.S. Pat. No. 4,901,335 is hereby incorporated by reference for its related teachings.

Figure 4:
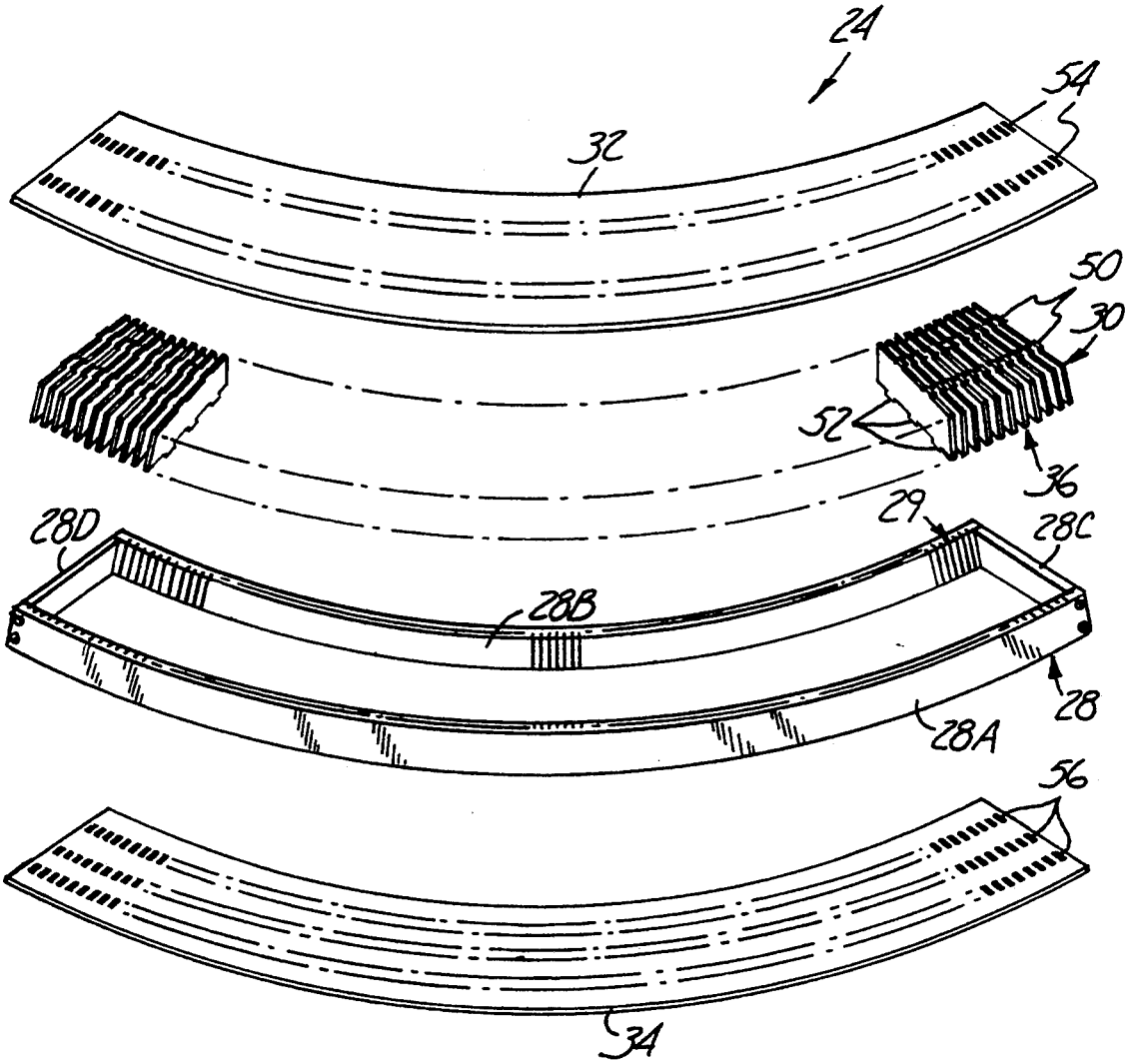
FIG. 4 is an exploded perspective view of the radiographic grid.

Slot grid 24 is formed on a cylindrical section centered on an axis through x-ray radiation source 12. Slot grid 24 has a reciprocating travel indicated by double headed arrow "A" and as fully described in U.S. Pat. No. 4,901,335. Referring to FIG. 4, the slot grid includes a grid housing 28, a plurality of x-ray radiation absorbing lamellae 30 disposed in grid housing and extending radially from an axis through x-ray radiation source 12, a top polymeric sheet 32 sealing an upper end of grid housing 28, and a bottom polymeric sheet sealing a lower end of grid housing 28.

Grid housing 28 includes a first side wall 28A, a second side wall 28B, a front wall 28C, and a back wall 28D. Side walls 28A and 28B each include a plurality of longitudinal slots 29 therein facing the interior of the grid housing and corresponding in number to the number of lamellae 30 to be positioned therebetween. The side walls are arc-shaped or bent along the circumference of a desired cylindrical section for slot grid 24 with individual lamellae 30 set in the longitudinal slots and extending radially from the longitudinal axis of the cylindrical section. In other words, the longitudinal slots 29 are positioned on side walls 28A and 28B such that the lamellae, when inserted therebetween, are focused to a convergent line at the x-ray radiation source spaced above grid housing 24.

Lamellae 30 are typically lead strips having a thickness between 0.075 mm and 0.25 mm. Lamellae 30 are evenly spaced in longitudinal slots 29 along the length of side walls 28A and 28B of slot grid 24 at a density of 3–6 strips per centimeter of slot grid 24. Between each pair of adjacent lamellae 30 is an air gap or slot 30. The ratio of the height of each slot 36 (i.e. the height of the lamellae 30) to its width (i.e. the distance between the lamellae 30) is a minimum of 5:1 and is potentially large as 30:1. Lamellae 30 themselves preferably have a height 3 to 20 mm. The higher slot height to width ratio results in substantially improved scattered radiation suppression and in noticeably improved image quality and contrast when compared to grids having interspace material between narrowly-spaced lamellae and smaller grid ratios.

Figure 2:
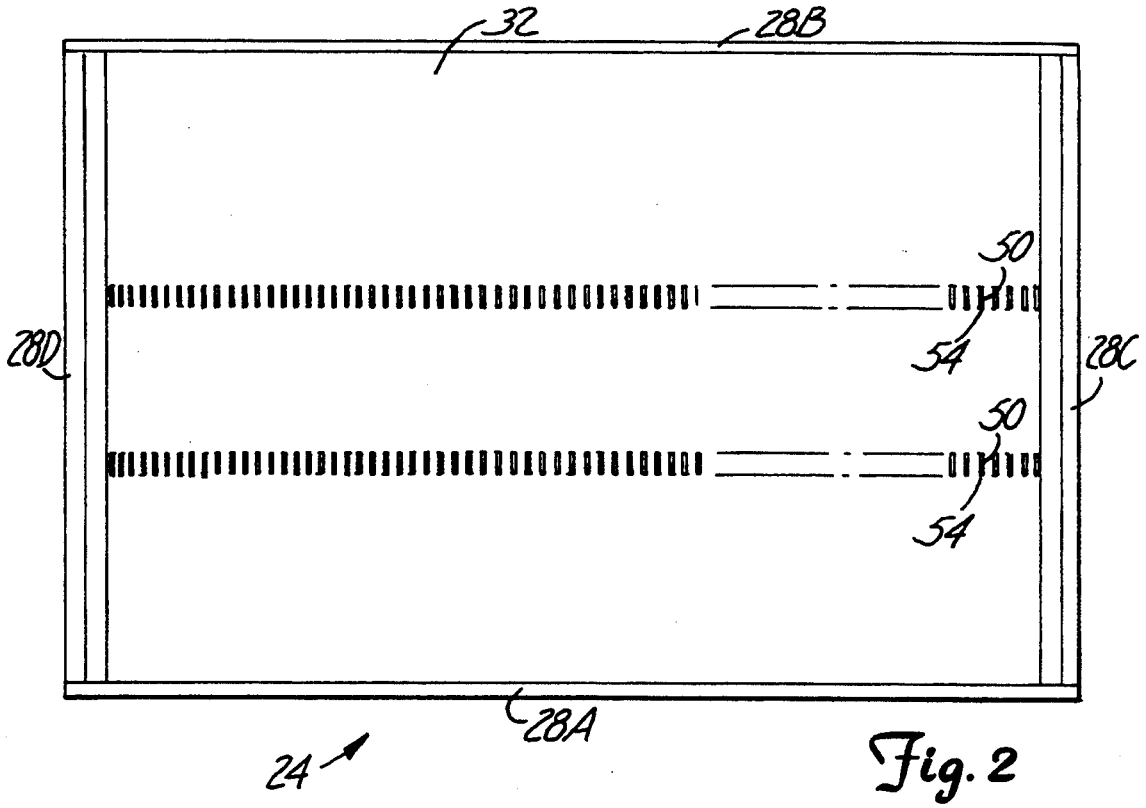
FIG. 2 is a top plan view of the radiographic grid.
Figure 3:
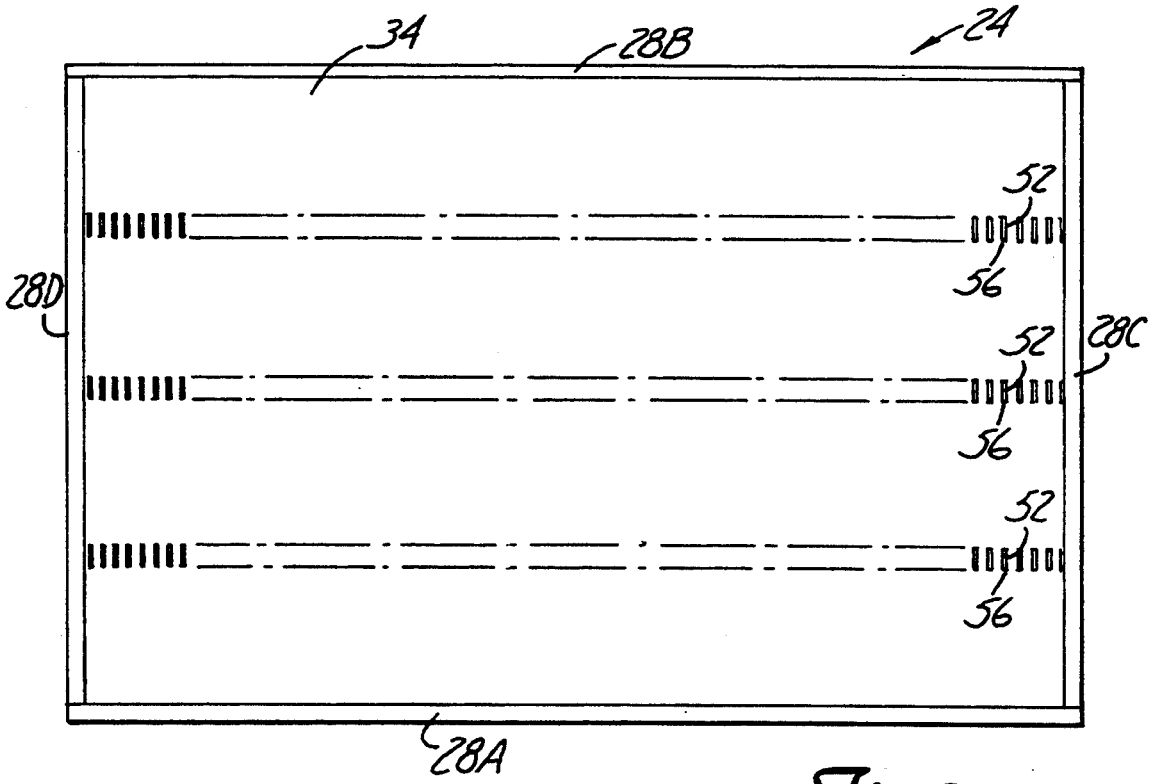
FIG. 3 is a bottom plan view of the radiographic grid.

Referring to FIGS. 2–4, the upper and lower ends of grid housing 28 are enclosed by thin polymeric top and bottom sheets 32 and 34, respectively. Each of the polymeric sheets have a thickness preferably between 0.025 and 0.127 mm, but no more than 0.17 mm. Top and bottom polymer sheets 32 and 34 have an adhesive along the peripheral border thereof for application of the polymeric sheets to the grid housing for maintaining lamellae 30 therebetween. The polymeric sheets are preferably mylar however, any type of flexible, dimensionally stable plastic may be used.

Lamellae 28 are engaged and maintained within the grid housing by alignment means. The alignment means defined in the present invention assure the straightness of the lamellae during assembly and provides a mechanism for greatly reducing the assembly time of the grid 24 from hours or days to approximately 20 minutes. In the preferred embodiment the alignment means includes at least one tab 50 protruding from a top edge of each lamellae 30 and at least one tab 52 protruding from a bottom edge of the each lamellae 30, and a corresponding number of slits 54 and 56 on both the top and bottom polymeric sheets, respectively, for engaging the corresponding tab 50 and 52 of each lamellae 30.

FIG. 2 shows a configuration in which the lamellae have two tabs 50 equidistantly spaced along the top edge of each lamellae 30 and a corresponding number of slits 54 on top polymeric sheet 32. FIG. 3 shows a configuration in which the lamellae have three tabs 52 equidistantly spaced along the bottom edge of each lamellae 30 and a corresponding number of slits 56 on bottom polymeric sheet 34. Each of the tabs has a length of approximately 5 mm, a width equal to the width of the lamellae (approximately 0.1778 mm) and a height of approximately 2 mm. Each of the slits has a dimension slightly larger than the dimension of length and width of the lamellae. It is within the intended scope of the present invention that the number, placement, shape, size and orientation of tabs 50 and 52 and slits 54 and 56 may be varied to suit particular design and manufacturing considerations. For example, depending on the dimensions of the grid housing the tabs may be one or more pins protruding from the edges of the lamellae or there may be a single tab and a single slit extending substantially the entire width of the grid housing.

Slot grid 24 is formed by first assembling grid housing 28 with the desired arc-shaped side walls 28A and 28B and longitudinal slots 29. The peripheral edge of bottom polymeric sheet 34 is bonded to the lower end of the grid housing using a conventional adhesive. Lamellae 30 are then individually secured in the grid housing by placing the ends of the lamellae into longitudinal slots 29 between side walls 28A and 28B. Tabs 52 on the lower edge of each lamellae are engaged in slots 56 on bottom polymeric sheet 34 to maintain the straightness of the lower edge of the lamellae during assembly. A tab holder such as a sheet of phosphor bronze of mylar having a thickness of 0.005 mm may be provided with slits on a lateral edge thereof corresponding to the spacing between tabs 50 on the lamella. The sheet of phosphor bronze is fitted onto the tabs 50 to maintain the appropriate distance of the upper edge of each lamellae 30 so that the top polymeric sheet 32 may be impressed onto tabs 50. After the top polymeric sheet is in place the sheet of phosphor bronze is removed and the top polymeric sheet pressed fully into place on the grid housing. The peripheral edge of the top polymeric sheet is coated with a conventional adhesive for bonding to the upper end of the grid housing.

Although the present invention has been described with reference to preferred embodiments, workers skilled in the art will recognize that changes may be made in form and detail without departing from the spirit and scope of the invention.

What is claimed is:

1. A radiographic grid comprising:

a grid housing having first and second side walls;

a first cover sheet disposed on the grid housing; and a plurality of x-ray radiation absorbing lamellae disposed between the first and second side walls of the grid housing, each of the plurality of lamellae having alignment means protruding from a lateral edge thereof for engaging the cover sheet such that each of the lamellae are maintained in alignment with respect to each other.

2. The radiographic grid of claim 1, wherein the grid housing is arc-shaped and wherein each of the plurality of lamellae are focused to a convergent line spaced apart from the grid housing.

3. The radiographic grid of claim 1, wherein the alignment means includes at least one tab protruding upward from a first edge of the lamellae, and wherein the cover sheet includes a plurality of slits corresponding to the tabs and engageable therewith.

4. The radiographic grid of claim 3, wherein the alignment means further includes at least one tab protruding upward from a second edge of the lamellae opposite the first edge, wherein the radiographic grid further comprises a second cover sheet disposed on the grid housing opposite the first cover sheet, and wherein the second cover sheet includes a plurality of slits corresponding to and engageable with the tabs protruding from the second edge of the lamellae.

5. The radiographic grid of claim 3, wherein the first cover sheet is disposed on a first surface of the grid housing and wherein each of the plurality of tabs extends through the corresponding slit in the first cover sheet beyond the first surface of the grid housing.

6. The radiographic grid of claim 3, wherein there are two tabs protruding from the first edge of each lamellae.

7. The radiographic grid of claim 3, wherein there are three tabs protruding from the first edge of each lamellae.

8. The radiographic grid of claim 1, wherein a height to width grid ratio is at least 5:1.

9. The radiographic grid of claim 1, wherein the first cover sheet is comprised of a polymeric sheet.

10. The radiographic grid of claim 9, wherein the cover sheet has a thickness of not greater than 0.17 mm.

11. The radiographic grid of claim 1, wherein the lamellae define an x-ray transmitting air spaced gap between adjacent lamellae.

12. The radiographic grid of claim 1, wherein first and second walls of the grid housing each includes longitudinal slots facing an interior of the grid housing for engaging a first and a second side edge of the lamellae, respectively, for alignment of the lamellae within the grid housing.

13. A method of constructing a radiographic grid comprising the steps of:

providing a grid housing having first and second side walls;

attaching a first cover sheet to the grid housing, the cover sheet having a plurality of slits thereon;

inserting a plurality of x-ray radiation absorbing lamellae between the side walls of the grid housing, each of the lamellae having at least one tab protruding from a first edge thereof; and engaging each of the tabs with selective slits on the cover sheet such that each of the lamellae are maintained in alignment with respect to each other.

14. The method of claim 13, further comprising the step of:

attaching a second cover sheet having a plurality of slits thereon to the grid housing opposite to the first cover sheet, and wherein each of tile lamellae have at least one tab protruding from a second edge thereof, opposite the first edge, for engaging the slits of the second cover sheet.

15. The method of claim 13, further comprising the steps of:

placing a pre-alignment sheet having slits thereon onto the grid housing for engagement with the tabs for maintaining the proper distance between the lamellae with respect to each other;

placing the cover sheet on top of the pre-alignment sheet such that the tabs initially engage the corresponding slits on the cover sheet; and removing the prealignment sheet thereby moving the cover sheet into full engagement with the grid housing.

16. The method of claim 13, wherein the grid housing is arc-shaped and wherein each of the plurality of lamellae are focused to a convergent line spaced apart from the grid housing.

17. The method of claim 13, wherein the grid ratio is at least 3:1.

18. The method of claim 13, wherein the first cover sheet is comprised of a polymeric sheet.

19. The method of claim 13, wherein the lamellae define an x-ray transmitting air spaced gap between adjacent lamellae.

20. The method of claim 13, wherein first and second walls of the grid housing each includes longitudinal slots facing an interior of the grid housing for engaging a first and a second side edge of the lamellae, respectively, for alignment of the lamellae within the grid housing.

* * * * *

UNITED STATES PATENT AND TRADEMARK OFFICE

CERTIFICATE OF CORRECTION

PATENT NO. : 5,357,553

DATED : October 18, 1994

INVENTOR(S) : DANIEL J. FERLIC, RANDOLPH M. FERLIC

It is certified that error appears in the above-indentified patent and that said Letters Patent is hereby corrected as shown below:

Col. 6, line 16, delete "tile", insert --the--

Signed and Sealed this

Twenty-first Day of February, 1995

*Attest:*

Bruce Lehman

BRUCE LEHMAN

*Attesting Officer*

*Commissioner of Patents and Trademarks*